US005545073A

United States Patent [19]

Kneisel et al.

[11] Patent Number: 5,545,073

[45] Date of Patent: Aug. 13, 1996

[54] SILICON MICROMACHINED $CO_2$ CLEANING NOZZLE AND METHOD

[75] Inventors: Lawrence L. Kneisel, Novi; Jay D. Baker, Dearborn; Lakhi N. Goenka, Ann Arbor, all of Mich.

[73] Assignee: Ford Motor Company, Dearborn, Mich.

[21] Appl. No.: 43,943

[22] Filed: Apr. 5, 1993

[51] Int. Cl.[6] ..... B24C 1/00; B24C 5/04

[52] U.S. Cl. ..... 451/39; 451/102; 451/75; 134/7

[58] Field of Search ..... 451/39, 75, 102; 134/7, 13

[56] References Cited

U.S. PATENT DOCUMENTS

| | | | |
|---|---|---|---|
| 3,676,963 | 7/1972 | Rice et al. | 51/320 |
| 3,878,978 | 4/1975 | Martinek | 225/1 |
| 4,038,786 | 8/1977 | Fong | 51/320 |
| 4,389,820 | 6/1983 | Fong et al. | 451/39 |
| 4,415,107 | 11/1983 | Palmieri | 225/93.5 |
| 4,519,812 | 5/1985 | Brull et al. | 51/422 |
| 4,545,155 | 10/1985 | Nakata | 51/320 |
| 4,631,250 | 12/1986 | Hayashi | 430/329 |
| 4,696,421 | 9/1987 | Durr | 225/1 |
| 4,747,421 | 5/1988 | Hayashi | 134/201 |
| 4,806,171 | 2/1989 | Whitlock | 451/39 |
| 4,828,184 | 5/1989 | Gardner et al. | 239/590 |
| 4,932,168 | 6/1990 | Tada et al. | 51/436 |
| 4,962,891 | 10/1990 | Layden | 239/597 |
| 5,018,667 | 5/1991 | Lloyd | 239/132.5 |
| 5,025,597 | 6/1991 | Tada et al. | 451/75 |
| 5,074,083 | 12/1991 | Kanno et al. | 451/75 |
| 5,111,984 | 5/1992 | Niedbala | 225/1 |
| 5,294,261 | 3/1994 | McDermott et al. | 134/7 |

OTHER PUBLICATIONS

"Elements of Gas Dynamics" by Liepmann and Roshko Chapter 5, pp. 124–125. 1957.

*Primary Examiner*—Jack W. Lavinder
*Attorney, Agent, or Firm*—Richard D. Dixon; Roger L. May

[57] ABSTRACT

An apparatus and method for cleaning a workpiece with abrasive $CO_2$ snow operates with a nozzle for creating and expelling the snow. The nozzle includes an upstream section for receiving $CO_2$ in a gaseous form, and having a first contour shaped for subsonic flow of the $CO_2$. The nozzle also includes a downstream section for directing the flow of the $CO_2$ and the snow toward the workpiece, with the downstream section having a second contour shaped for supersonic flow of the $CO_2$. The nozzle includes a throat section, interposed between the upstream and downstream sections, for changing the $CO_2$ from the gaseous phase along a constant entropy line to a gas and snow mixture within the downstream section at a speed of at least Mach 1.0. In this manner, additional kinetic energy is imparted to the snow by delaying the conversion into the solid phase until the gaseous $CO_2$ reaches supersonic speeds.

19 Claims, 1 Drawing Sheet

SILICON MICROMACHINED $CO_2$ CLEANING NOZZLE AND METHOD

FIELD OF THE INVENTION

The present invention relates to an apparatus and method for creating abrasive $CO_2$ snow at supersonic speeds and for focusing the snow on contaminants to be removed from a workpiece.

BACKGROUND OF THE INVENTION

The use of liquid carbon dioxide for producing $CO_2$ snow and subsequently accelerating it to high speeds for cleaning minute particles from a substrate is taught by Layden in U.S. Pat. No. 4,962,891. A saturated $CO_2$ liquid having an entropy below 135 BTU per pound is passed though a nozzle for creating, through adiabatic expansion, a mix of gas and the $CO_2$ snow. A series of chambers and plates are used to improve the formation and control of larger droplets of liquid $CO_2$ that are then converted through adiabatic expansion to the $CO_2$ snow. The walls of the ejection nozzle for the $CO_2$ snow are suitably tapered at an angle of divergence of about 4 to 8 degrees, but this angle is always held below 15 degrees so that the intensity of the stream of the solid/gas $CO_2$ will not be reduced below that which is necessary to clean the workpiece. The nozzle may be manufactured of fused silica, quartz or some other similar material.

However, this apparatus and process, like other prior art technologies, utilizes a Bernoulli process that involves incompressible gasses or liquids that are forced through a nozzle to expand and change state to snow or to solid pellets. Also, the output nozzle functions as a diffusion promoting device that actually reduces the exit flow rate by forming eddy currents near the nozzle walls. This mechanism reduces the energy and the uniformity of the snow distributed within the exit fluid, which normally includes liquids and gasses as well as the solid snow.

Some references, such as Lloyd in U.S. Pat. No. 5,018,667 at columns 5 and 7, even teach the use of multiple nozzles and tapered orifices in order to increase the turbulence in the flow of the $CO_2$ and snow mixture. These references seek to disperse the snow rather than to focus it after exiting the exhaust nozzle. At column 7, lines 34–51, Lloyd indicates that the snow should be created at about one-half of the way through the nozzle in order to prevent a clogging or "snowing" of the nozzle. While Lloyd recognizes that the pressure drop in a particular orifice is a function of the inlet pressure, the outlet pressure, the orifice diameter and the orifice length, his major concern was defining the optimum aspect ratio, or the ratio of the length of an orifice to the diameter of the orifice, in order to prevent the "snowing" of the orifice.

A common infirmity in all of these references is that additional energy must be provided to accelerate the snow to the desired exit speed from the nozzle when the snow is not created in the area of the exhaust nozzle.

Therefore, it is a primary object of the present invention to create the $CO_2$ snow at a location downstream of the throat in the nozzle such that the supersonic speed of the $CO_2$ will be transferred to the snow, while simultaneously focusing the snow and the exhaust gas into a fine stream that can be used for fineline cleaning applications.

SUMMARY OF THE INVENTION

An apparatus and method for cleaning a workpiece with abrasive $CO_2$ snow operates with a nozzle for creating and expelling the snow. The nozzle includes an upstream section for receiving $CO_2$ in a gaseous format a first pressure, and having a first contour shaped for subsonic flow of the $CO_2$. The nozzle also includes a downstream section for directing the flow of the $CO_2$ and the snow toward the workpiece, with the downstream section having a second contour shaped for supersonic flow of the $CO_2$. The nozzle includes a throat section, interposed between the upstream and downstream sections, for changing the $CO_2$ from the gaseous phase along a constant entropy line to a gas and snow mixture within said downstream section at a speed of at least Mach 1.1. In this manner, additional kinetic energy is imparted to the snow by delaying the conversion into the solid phase until the gaseous $CO_2$ reaches supersonic speeds in the downstream section of the nozzle.

In the first preferred embodiment the second contour is shaped for minimizing boundary layer buildup as the $CO_2$ passes therethrough, thereby minimizing turbulence in the flow of the mixture as it exits the nozzle. The second contour is shaped to achieve a parallel flow of the $CO_2$ gas and snow as it exits the downstream section, thereby focusing the snow into a small pattern for abrasive application to the workpiece.

The throat, upstream and downstream sections of the nozzle are silicon micromachined surfaces.

BRIEF DESCRIPTION OF THE DRAWINGS

Other objects, features and advantages of the present invention will be apparent from a study of the written descriptions and the drawings in which.

DESCRIPTION OF THE PREFERRED EMBODIMENT AND METHOD

Figure 1:
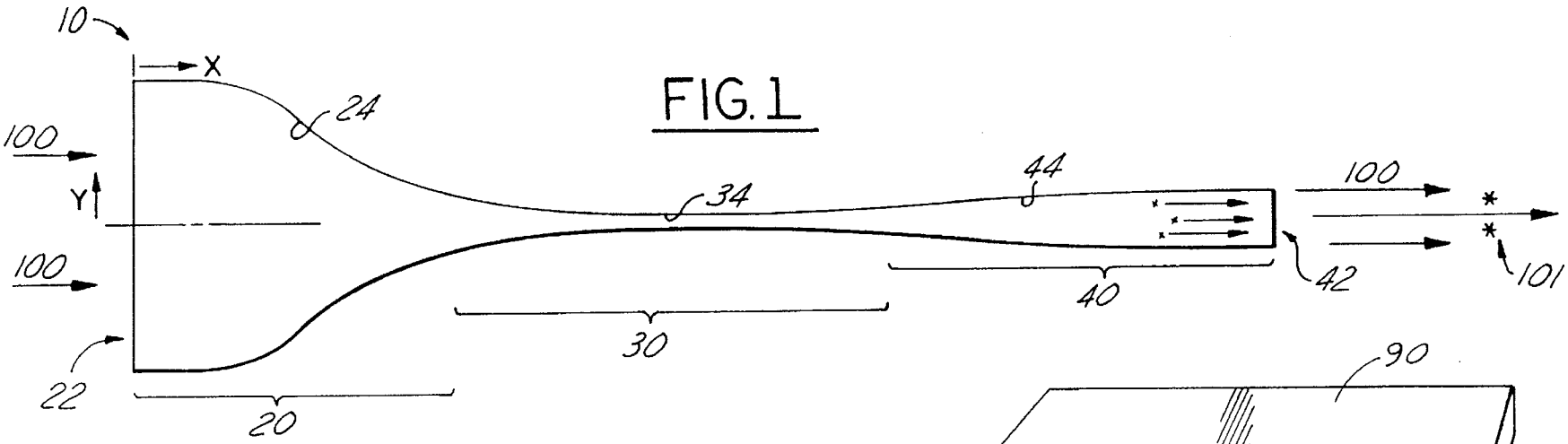
FIG. 1 is a functional diagram of the silicon micromachined nozzle in accordance the present invention. This diagram is not drawn to scale, and reference should be made to Table 1 for the exact dimensions of the preferred embodiment.

A simplified, sectional view of a nozzle in accordance with the present invention is illustrated generally as 10 in FIG. 1. The nozzle 10 includes an upstream section 20, a downstream section 40 and a throat section 30. An open end 22 receives therein carbon dioxide gas 100 from a storage container (not shown) under pressure ranging from about 100 psi to 800 psi, with about 300 psi being preferred. The $CO_2$ gas could be supplied with an input temperature of from −40 degrees F. and +90 degrees F., but any substantial deviations from the design input temperature of +40 degrees F. could require design changes in the nozzle. The $CO_2$ gas may be cooled before entering the open end 22 of the nozzle 10 if additional conversion efficiency in making snow is required.

The contour or curvature of the inside surface 24 of the upstream section 20 of the nozzle is designed according to the matched-cubic design procedure described by Thomas Morel in "Design of 2-D Wind Tunnel Contractions", Journal of Fluids Engineering, 1977, vol. 99. According to this design the gaseous $CO_2$ flows at subsonic speeds of approximately 20 to 100 feet per second as it approaches the throat section 30.

The downstream section 40 includes an open end 42 for exhausting the carbon dioxide gas 100 and the resulting snow 101 toward a workpiece (not shown) under ambient exhaust pressures. The contour or curvature of the inside surface 34 of the throat section 30 and the inside surface 44 of the downstream section 40 of the nozzle are designed according to a computer program employing the Method of Characteristics as explained by J. C. Sivells in the article "A Computer Program for the Aerodynamic Design of Axisymmetric and Planar Nozzles for Supersonic and Hypersonic Wind Tunnels", AEDC-JR-78-63, that can be obtained from the U.S. Air Force.

Figure 3:
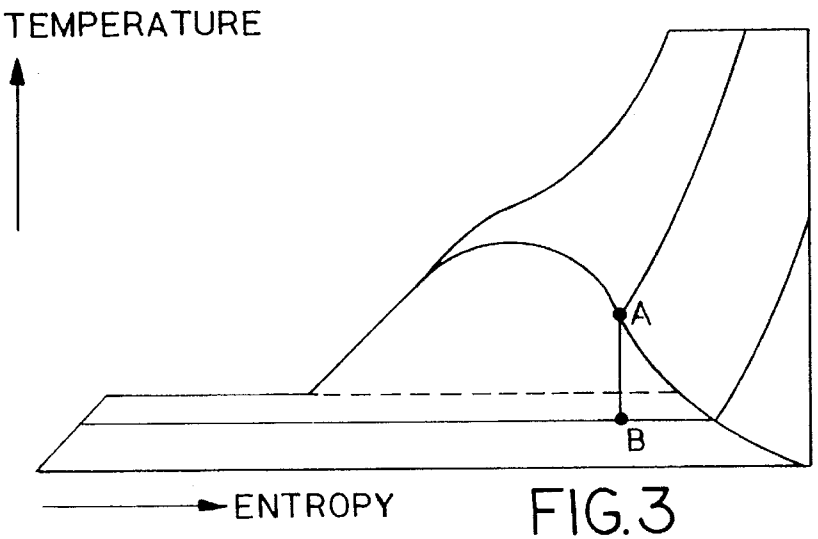
FIG. 3 is a simplified diagram of the thermodynamic properties of $CO_2$ showing the constant entropy lines as a function of temperature and pressure.

The contour of the interior surface 34 of the throat section 30 is designed to cause an adiabatic expansion of the $CO_2$ gasses passing therethrough. The $CO_2$ gas expands in accordance with the temperature-entropy chart illustrated in FIG. 3, generally moving along the constant entropy line from point A to point B. When pressure is reduced to point B, the $CO_2$ gas will convert at least partially to snow. This conversion to snow 101 is designed to occur near the exhaust port 42 of the downstream section 40 of the nozzle so that additional kinetic energy will not be required to accelerate the snow 101 toward the workpiece. The location of the conversion occurs at supersonic speeds at the exhaust port 42, with the preferred embodiment design calling for a Mach 2.5 exit speed for the $CO_2$ gas and the snow. The conversion to snow will not occur in the throat section 30 of the nozzle 10 because the speed of the $CO_2$ gas traveling therethrough is designed only to be 1.0 Mach, which results in a pressure above that required to cause snow to occur. As defined herein, snow is considered to be small, solid phase particles of $CO_2$ having mean diameters of approximately 10 micrometers and exhibiting a more or less uniform distribution in particle size. The term Mach is defined as the speed of sound with a gas at a given pressure and temperature.

The contours of the inside surfaces 34 and 44 also are designed such that at supersonic flow rates the gaseous $CO_2$ flows directly out of the exhaust port 42 while obtaining a uniform flow-distribution at the nozzle exhaust 42. This should result in the intended collinear exhaust flow.

Because of the low dispersion design of the throat 30 and the downstream section 40 of the nozzle 10, the exhaust pattern is maintained and focused at about the same size as the cross section of the nozzle exit 42 (approximately 20 by 450 micrometers in the preferred embodiment) even at 1 to 5 centimeters from the nozzle exit 42. The precise exhaust pattern also provides an even distribution of snow throughout the exhaust gasses.

Figure 2:
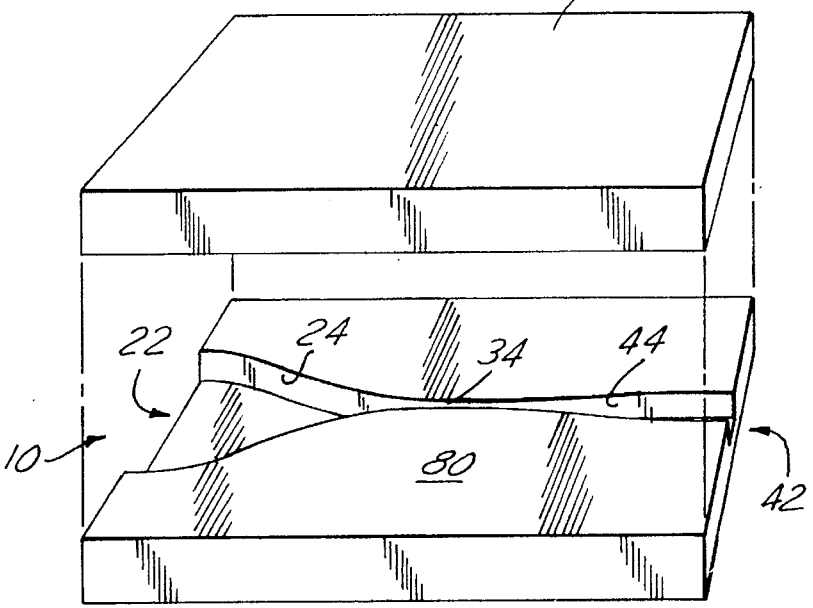
FIG. 2 is an exploded perspective view of the nozzle as it is would be assembled.

As may be observed from the foregoing discussion, the many advantages of the present invention are due in large part to the precise design and dimensions of the internal contoured surfaces 24, 34 and 44 of the nozzle 10, which are obtained through the use of silicon micromachine processing. FIG. 2 illustrates a perspective view of a silicon substrate 80 into which the contours 24, 34 and 44 of the nozzle 10 were etched using well known photolithographic processing technologies. In the first preferred embodiment the throat section 30 is etched approximately 20 micrometers down into the substrate 80 and then another planar substrate 90 would be placed upon and fused (fusion bonding) to the planar substrate in order to seal the nozzle 10.

The precise control of the shape and size of the nozzle 10 allows the system to be sized to create a rectangular snow pattern of only 20 by 441 micrometers (approximately). This allows the nozzle and system to be used for cleaning small areas of a printed circuit board that has been fouled by flux, solder or other contaminants during manufacturing or repair operations.

An additional advantage of using such a small footprint of the snow 101 is that any electrostatic charge generated by tribo-electric action of the snow and the gaseous $CO_2$ against the circuit board or other workpiece being cleaned is proportional to the size of the exhaust pattern. Therefore, as the snow footprint is minimized in size, the resulting electrostatic charge can be minimized so as to be easily dissipated by the workpiece without causing damage to sensitive electronic components mounted thereon. This advantage makes the system especially well-suited for cleaning and repairing fully populated printed circuit boards. Because the nozzle is very small, it can be housed in a hand-held, portable cleaning device capable of being used in a variety of cleaning applications and locations.

BEST MODE EXAMPLE

The dimensions of the presently preferred embodiment of the silicon micromachined nozzle are listed in Table 1 attached hereto. The X dimension is measured in micrometers along the central flow axis of the nozzle, while the Y dimension is measured from the central flow axis to the contoured surface of the nozzle wall. The rectangular throat section 30 of the nozzle 10 measures 200 micrometers from one contour surface to the other, or 100 micrometers from the centerline to the contour surface. As previously discussed, the throat section 30 of the nozzle 10 is approximately 20 micrometers in depth.

Pure carbon dioxide gas at 30 degrees F. and 300 psi is coupled to the upstream end 20 of the nozzle 10. The $CO_2$ at the output from the downstream section of the nozzle has a temperature of about −150 degrees F. and a velocity of approximately 1200 feet per second. The output $CO_2$ includes approximately 15–30% by mass of solid $CO_2$ snow which have a mean particle size of approximately 10 micrometers. The throat and downstream sections of the nozzle are sized so as to create a mix of exhausted $CO_2$ gas and snow in the approximate ratio of 5 to 1. The size of the exhaust gas jet is approximately 20 by 441 micrometers, and the nozzle is designed to be used approximately 2 centimeters from the workpiece. Angles of attack of the snow against the workpiece can vary from 0 degrees to 90 degrees.

The exact contour of the nozzle may be more accurately defined according to Table 1 as follows:

TABLE 1

| Throat = | | 200 |
|---|---|---|
| Depth = | | 20 |
| X | Y | Mask |
| 0 | 1000 | 980.0 |
| 200 | 998.2 | 978.2 |
| 400 | 986.2 | 966.2 |
| 500 | 973.2 | 953.2 |
| 600 | 953.8 | 933.8 |
| 800 | 890.2 | 870.2 |
| 1000 | 785.6 | 765.6 |
| 1200 | 644.2 | 624.2 |
| 1400 | 519.2 | 499.2 |
| 1600 | 415 | 395.0 |
| 1800 | 329.6 | 309.6 |
| 2000 | 261.2 | 241.2 |
| 2200 | 208 | 188.0 |
| 2400 | 168 | 148.0 |
| 2600 | 139.4 | 119.4 |

TABLE 1-continued

| | | |
|---|---|---|
| 2800 | 120.2 | 100.2 |
| 3000 | 108.6 | 88.6 |
| 3200 | 102.6 | 82.6 |
| 3400 | 100.4 | 80.4 |
| 3600 | 100 | 80.0 |
| 3639.2 | 100 | 80.0 |
| 3893.2 | 100.6 | 80.6 |
| 4082.2 | 102.2 | 82.2 |
| 4292.6 | 105.6 | 85.6 |
| 4522.6 | 112 | 92.0 |
| 4773.6 | 123.2 | 103.2 |
| 5046.6 | 140.2 | 120.2 |
| 5342 | 163 | 143.0 |
| 5653.8 | 187 | 167.0 |
| 5970 | 205.6 | 185.6 |
| 6278.4 | 215.6 | 195.6 |
| 6574.4 | 219.4 | 199.4 |
| 6861.2 | 220.4 | 200.4 |
| 6978.8 | 220.6 | 200.6 |

While the present invention has been particularly described in terms of specific embodiments thereof, it will be understood that numerous variations of the invention are within the skill of the art and yet are within the teachings of the technology and the invention herein. Accordingly, the present invention is to be broadly construed and limited only by the scope and spirit of the following claims.

We claim:

1. An apparatus for cleaning a workpiece with abrasive $CO_2$ snow, comprising a nozzle for creating and expelling the snow, including;

an upstream section for receiving $CO_2$ gas at a first pressure, said upstream section having a first contour optimized for subsonic flow of the $CO_2$ gas at said first pressure, a downstream section for directing the flow of the $CO_2$ gas and the snow toward the workpiece, said downstream section having a second contour optimized for supersonic flow of the $CO_2$ gas at a second pressure, and throat means, coupled to and for cooperating with said upstream and downstream sections, for changing the $CO_2$ gas from the gaseous phase generally along a constant entropy line at least partially into snow within said downstream section at a speed of at least Mach 1.1, whereby increased kinetic energy is imparted to the abrasive snow particles by delaying the conversion of the $CO_2$ gas into the solid phase until the gaseous $CO_2$ reaches supersonic speeds in said downstream section of said nozzle.

2. The apparatus as described in claim 1 wherein said second contour is optimized for minimizing turbulence and focusing the flow of the snow as it exits the nozzle.

3. The apparatus as described in claim 1 wherein said second contour is shaped to achieve a parallel flow of the $CO_2$ gas and snow exiting said downstream section, thereby focusing the snow in a small footprint for abrasive application to the workpiece.

4. The apparatus as described in claim 1 wherein said throat, upstream and downstream sections of said nozzle comprise silicon micromachined surfaces.

5. The apparatus as described in claim 1 wherein the cross-section of said throat section is generally rectangular in shape.

6. The apparatus as described in claim 1 wherein the speed of the $CO_2$ gas in said downstream section is at least Mach 2.0.

7. The apparatus as described in claim 1 wherein said first pressure is in the range of 100 to 800 psi.

8. The apparatus as described in claim 1 wherein a contour of said throat section accelerates the $CO_2$ gas as it passes therethrough.

9. The apparatus as described in claim 1 wherein said throat and downstream sections of said nozzle are formed by surfaces of a silicon material for controlling the footprint of the exhausted $CO_2$ gas and snow and for minimizing the resulting electrostatic charge of the exhausted $CO_2$ gas and snow.

10. The apparatus as described in claim 1 wherein said throat and downstream sections of said nozzle produce a mix of exhausted $CO_2$ gas and snow in the approximate ratio of 5 to 1 by mass.

11. A method for cleaning a workpiece with abrasive $CO_2$ snow, comprising:

receiving $CO_2$ in a gaseous form in an upstream section of a nozzle having a first contour shaped for subsonic flow of the $CO_2$ gas, passing the $CO_2$ gas through a throat section of the nozzle shaped for delaying the phase change of the $CO_2$ from the gaseous phase along a constant entropy line into a mixture of $CO_2$ gas and snow within a downstream section spaced from the throat section, passing the $CO_2$ gas through the downstream section of the nozzle having a second contour for directing the flow of the $CO_2$ gas and snow toward the workpiece at a speed greater than Mach 1.1, whereby increased kinetic energy is imparted to the snow by delaying the conversion into the solid phase until the gaseous $CO_2$ reaches supersonic speeds in the downstream section of the nozzle.

12. The method as described in claim 11 further including the step of minimizing boundary layer buildup through the throat and downstream sections of the nozzle as the $CO_2$ passes therethrough, thereby minimizing turbulence in the flow of the snow as it exits the nozzle.

13. The method as described in claim 11 further including the step of creating a generally parallel flow of $CO_2$ gas and snow exiting the downstream section, thereby focusing the snow into a small footprint for abrasive application to the workpiece.

14. The method as described in claim 11 further including the step of accelerating the $CO_2$ gas to a speed of at least Mach 2.0 in the downstream section.

15. The method as described in claim 11 further including the step of accelerating the $CO_2$ gas as it passes out of the throat section.

16. The method as described in claim 11 further including the step of focusing the flow of the $CO_2$ gas and the snow flowing through the downstream section of the nozzle for controlling the shape of the abrasive footprint generated by the exhausted $CO_2$ gas and snow acting on the workpiece.

17. The method as described in claim 11 further including the step of generating a mix of exhausted $CO_2$ gas and snow in the approximate ratio of 5 to 1 by mass.

18. A method for ablating a workpiece with abrasive $CO_2$ snow, comprising:

receiving $CO_2$ in a gaseous form in an upstream section of a nozzle having a first contour shaped for subsonic flow of the $CO_2$ gas, passing the $CO_2$ gas through a throat section of the nozzle shaped for delaying the phase change of the $CO_2$ from the gaseous phase along a constant entropy line into a mixture of $CO_2$ gas and snow within a downstream section spaced from the throat section, passing the $CO_2$ gas and snow through the downstream section of the nozzle having a second contour shaped for directing the flow of the $CO_2$ gas and the snow toward the workpiece at a speed greater than Mach 1.1, whereby increased kinetic energy is imparted to the snow by delaying the conversion into the solid phase until the gaseous $CO_2$ reaches supersonic speeds in the downstream section of the nozzle.

19. The method as described in claim 18 further including the step of accelerating the $CO_2$ gas to a speed of at least Mach 2.0 in the downstream section of the nozzle before the $CO_2$ gas is converted into a mixture of $CO_2$ snow and gas.

* * * * *